US008469174B2

(12) United States Patent
Wu et al.

(10) Patent No.: US 8,469,174 B2
(45) Date of Patent: Jun. 25, 2013

(54) VALUABLE DOCUMENT RECEIVING AND ALIGNMENT METHOD

(75) Inventors: Shih-Pin Wu, Tainan (TW); Pin-Chia Lee, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 107 days.

(21) Appl. No.: 13/158,730

(22) Filed: Jun. 13, 2011

(65) Prior Publication Data

US 2012/0312659 A1 Dec. 13, 2012

(51) Int. Cl.
*G07D 7/00* (2006.01)
*G07F 7/04* (2006.01)

(52) U.S. Cl.
USPC ..... 194/302; 194/344

(58) Field of Classification Search
USPC .. 194/206, 207, 302, 342, 344, 351; 271/226, 271/227, 248, 250, 229, 242; 209/534; 235/379; 414/754, 780, 783; 198/376, 401, 406, 524
See application file for complete search history.

(56) References Cited

U.S. PATENT DOCUMENTS

2009/0035118 A1* 2/2009 Sperl et al. ..... 414/754

* cited by examiner

*Primary Examiner* — Mark Beauchaine
(74) *Attorney, Agent, or Firm* — Muncy, Geissler, Olds & Lowe, PLLC

(57) ABSTRACT

A valuable document receiving and alignment method includes the steps of (a) a user inserts a valuable document obliquely into a transversely tilted tunnel, (b) a validation unit of the valuable document receiver senses the inserted valuable document and controls a delivery mechanism to hold down the valuable document, (c) a sheet-deliver wheel module of the delivery mechanism delivers the valuable document forwardly to a predetermined distance and the user releases the hand from the valuable document, (d) the sheet-deliver wheel module releases the valuable document for enabling it to fall downwardly to the lower side wall of the transversely tilted tunnel and to let one side edge of the valuable document be abutted against the lower side wall, and (e) the sheet-deliver wheel module delivers the valuable document to a validation position for enabling the validation unit to identify the authenticity and value of the valuable document.

6 Claims, 9 Drawing Sheets

VALUABLE DOCUMENT RECEIVING AND ALIGNMENT METHOD

BACKGROUND OF THE INVENTION

1. Field of the Invention

The present invention relates to valuable document receiving technology and more particularly, to a valuable document receiving and alignment method for a valuable document receiver, which take the advantage of gravity to let the inserted valuable document fall to the lower side wall of a transversely tilted tunnel in an accurately aligned position for further delivery to a validation unit for enabling the validation unit to identify the authenticity and value of the valuable document correctly.

2. Description of the Related Art

Following fast development of social civilization and technology, people accelerate their pace of life and require a better quality of life. In consequence, various automatic vending machines are used everywhere to sell different products without serviceman, bringing convenience to people and helping suppliers save much labor cost. Following increasing of selling items, new automatic vending machines with added functions are created.

To get rid of receiving counterfeit bills counterfeits, a valuable document receiver for automatic vending machine or gaming machine generally uses a validation device to identify the authenticity and value of the inserted valuable document. However, conventional valuable document receivers are commonly designed for receiving one particular valuable document only. Because different valuable documents issued in different countries have different security features at different locations. The inserted valuable document must be accurately aligned so that the validation device can correctly identify the security features. If the insertable valuable document is not kept in accurately aligned, a false identification result may occur.

There are valuable document receivers equipped with an alignment mechanism or position adjustment mechanism for moving two clamping arms at two opposite lateral sides of the valuable document tunnel to move the inserted valuable document into accurate alignment with a validation device when the inserted valuable document is being carried forwards by sheet-deliver roller toward the validation device. When the clamping arms are operated to correct an inserted valuable document, the valuable document may be forced to curve by the clamping arms, causing the validation device unable to correctly identify the security features of the valuable document. Further, the valuable document may be jammed in the clamping arms during position correction. Furthermore, the design and use of the alignment mechanism or position adjustment mechanism is complex thus the cost is expensive.

Therefore, it is desirable to provide a valuable document receiver, which eliminates the aforesaid problems.

SUMMARY OF THE INVENTION

The present invention has been accomplished under the circumstances in view. It is the main object of the present invention to provide a valuable document receiving and alignment method, which is employed to a valuable document receiver to assure accurate alignment of an inserted valuable document, enabling a validation unit to correctly identify the authenticity and value of the valuable document. It is another object of the present invention to a valuable document receiving and alignment method, which simplifies the structural arrangement of the valuable document receiver, facilitating maintenance and saving much the cost.

To achieve these and other objects of the present invention, a valuable document receiving and alignment method includes the steps of (a) a user inserts a valuable document obliquely into a transversely tilted tunnel of a valuable document receiver, (b) a validation unit of the valuable document receiver senses the inserted valuable document and controls a delivery mechanism to hold down the valuable document, (c) a sheet-deliver wheel module of the delivery mechanism delivers the valuable document forwardly to a predetermined distance and the user releases the hand from the valuable document, (d) the sheet-deliver wheel module releases the valuable document for enabling it to fall downwardly to the lower side wall of the transversely tilted tunnel and to let one side edge of the valuable document be abutted against the lower side wall, and (e) the sheet-deliver wheel module delivers the valuable document to a validation position for enabling the validation unit to identify the authenticity and value of the valuable document.

Further, the transversely tilted tunnel of the valuable document receiver defines with the tilt angle relative to horizontal within the range of 10°~89°, or preferably, 30°~75°. Thus, when the delivery mechanism releases the valuable document, the valuable document is dropped by its weight due to gravity to fall to the lower side wall of the transversely tilted tunnel and to let one side edge of the valuable document be abutted against the lower side wall, thus, the sheet-deliver wheel module can deliver the valuable document accurately and smoothly to the validation position without wrinkles, enabling the validation unit to identify the authenticity and value of the valuable document. As no any further complicated alignment mechanism or position adjustment mechanism is necessary to assist alignment of the valuable document, the structural arrangement of the valuable document receiver is simplified, facilitating maintenance and saving much the cost.

DETAILED DESCRIPTION OF THE PREFERRED EMBODIMENT

The objective and effects of the present invention will be fully understood by way of the following preferred embodiment in conjunction with the annexed drawings.

Figure 1:
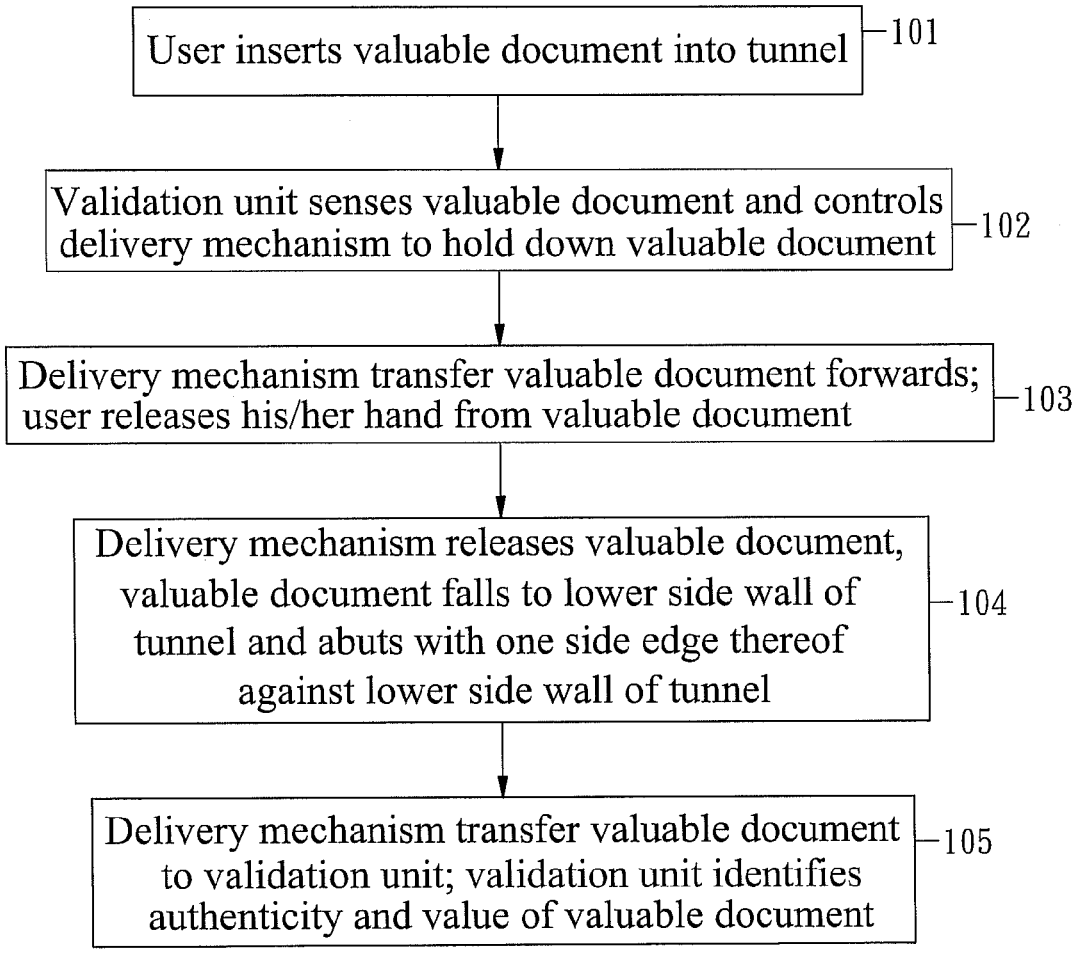
FIG. 1 is an operation flow chart of a valuable document receiving and alignment method in accordance with the present invention.
Figure 2:
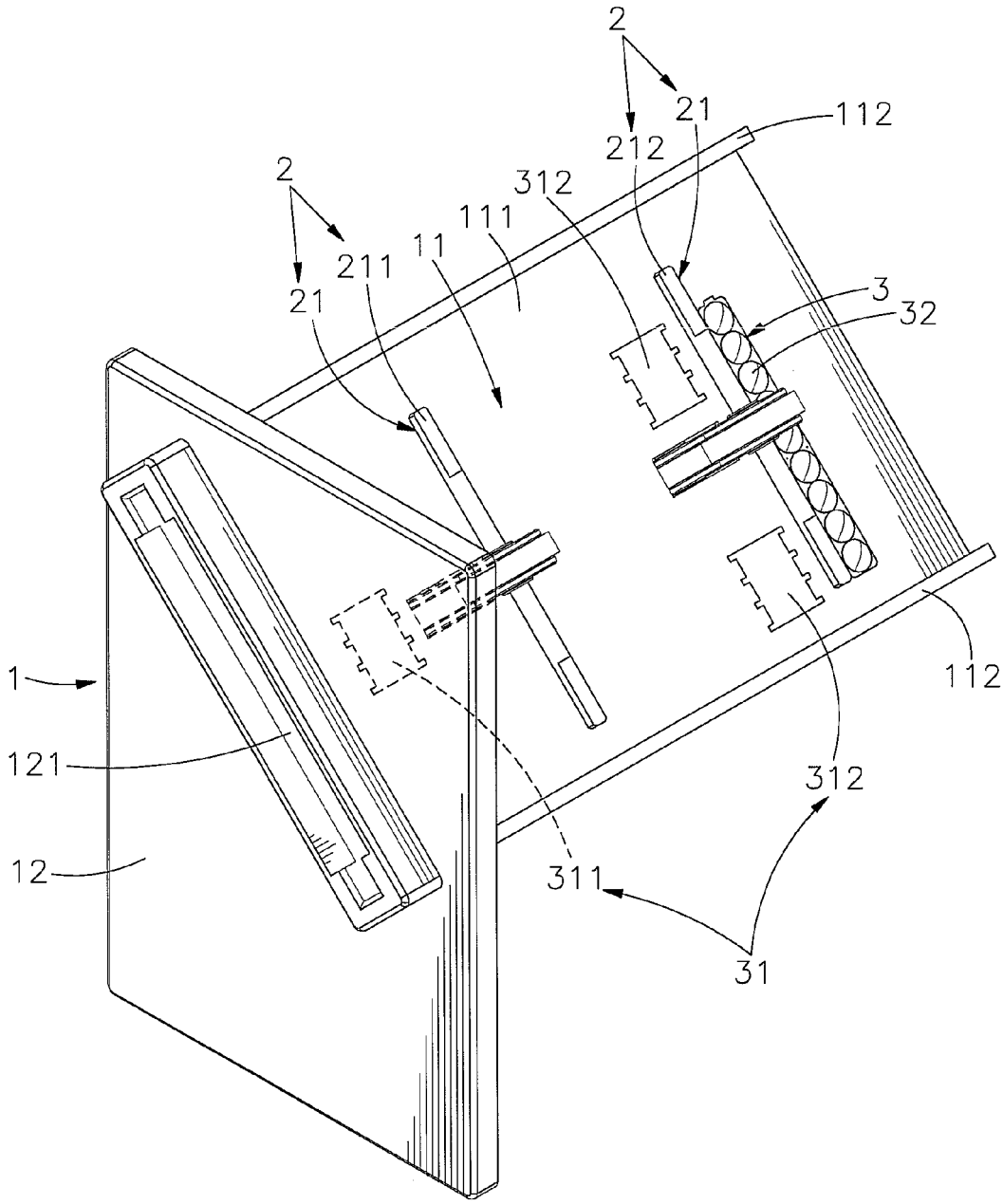
FIG. 2 is a schematic perspective view of a valuable document receiver constructed according to the present invention.
Figure 3:
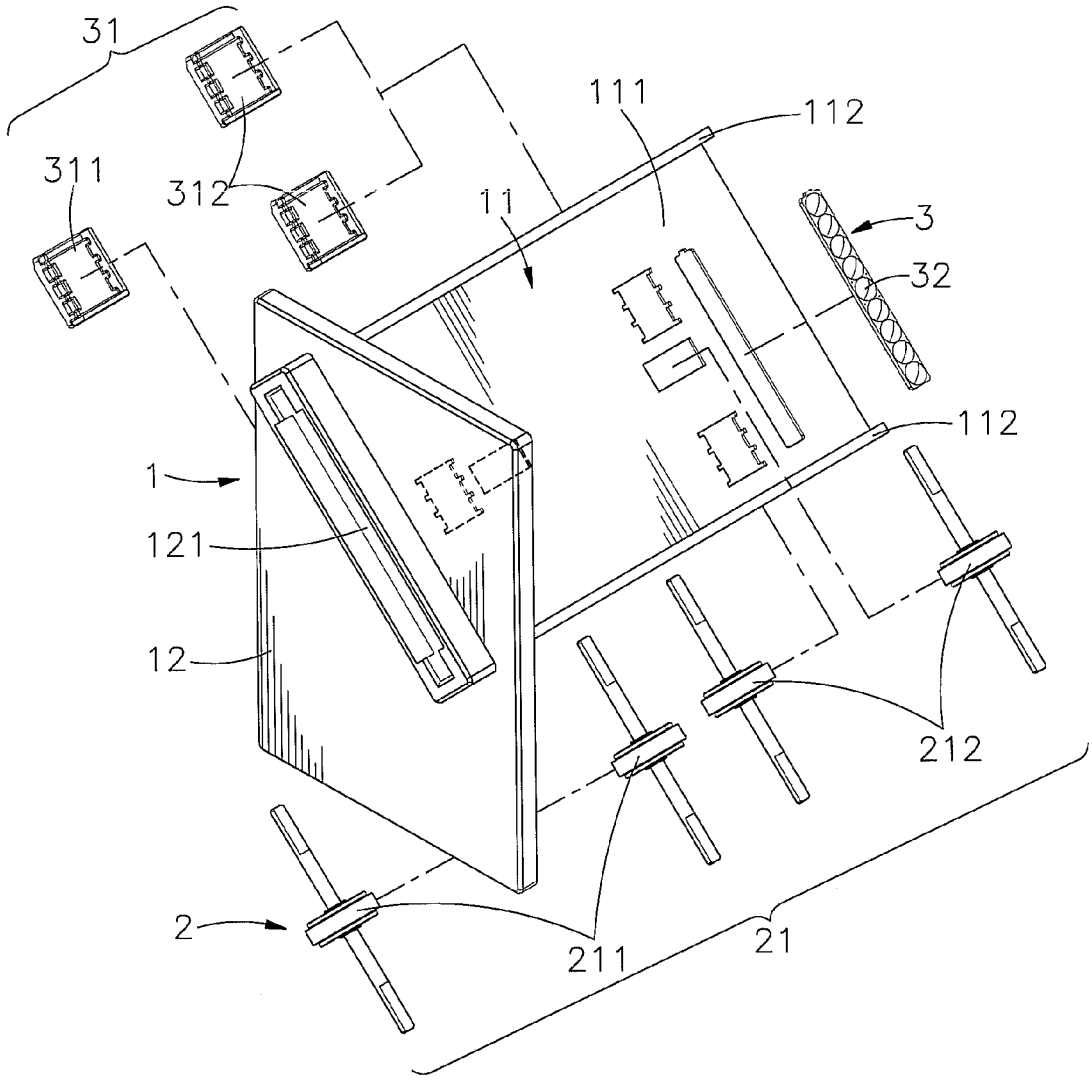
FIG. 3 is a schematic exploded view of the valuable document receiver shown in FIG. 2.

Referring to FIGS. 1~3, the invention is employed to a valuable document receiver comprising a housing 1, a delivery mechanism 2, and a validation unit 3.

Figure 4:
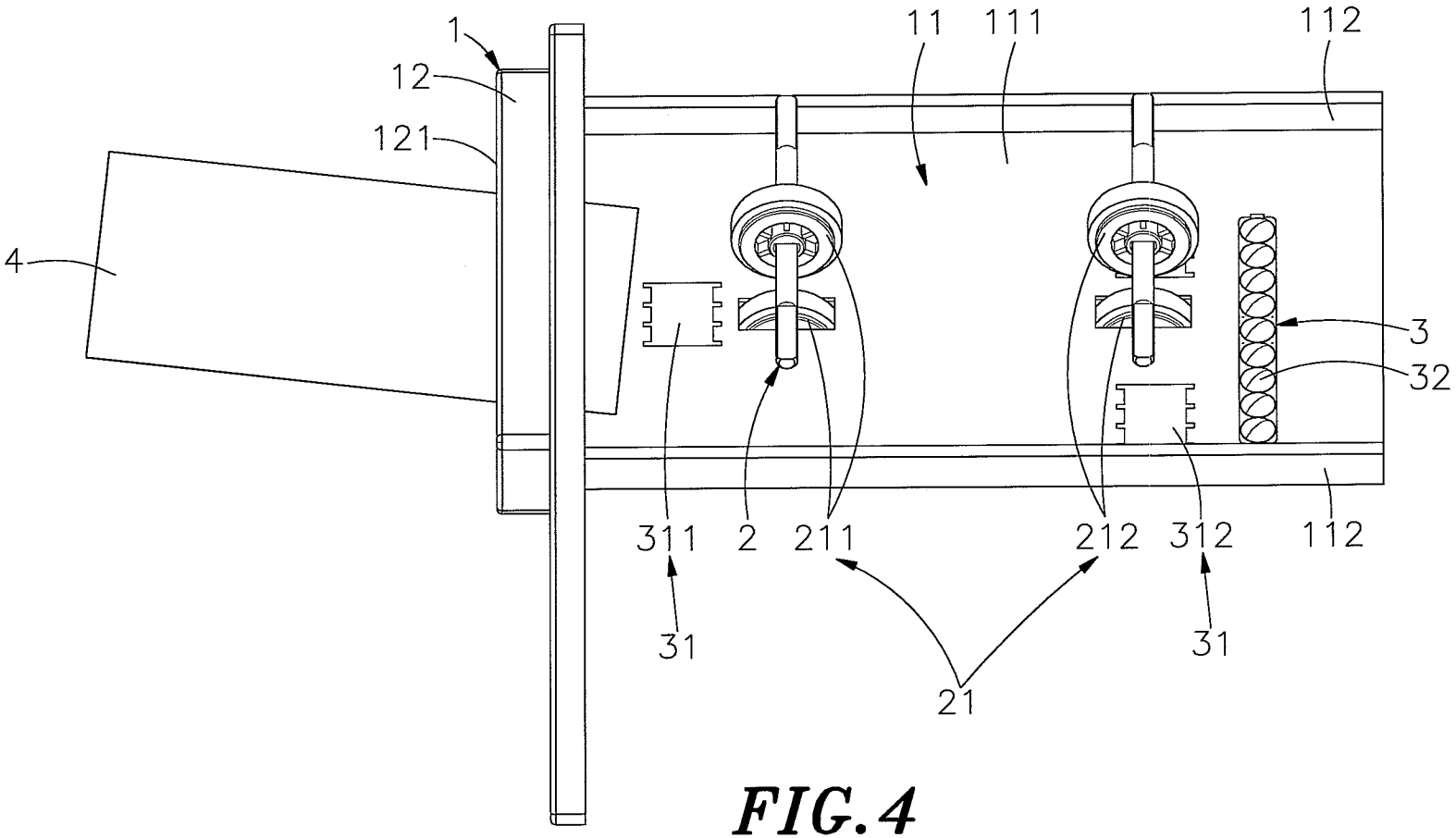
FIG. 4 is a schematic side view illustrating a valuable document obliquely inserted into the insertion slot of the valuable document receiver in accordance with the present invention.
Figure 5:
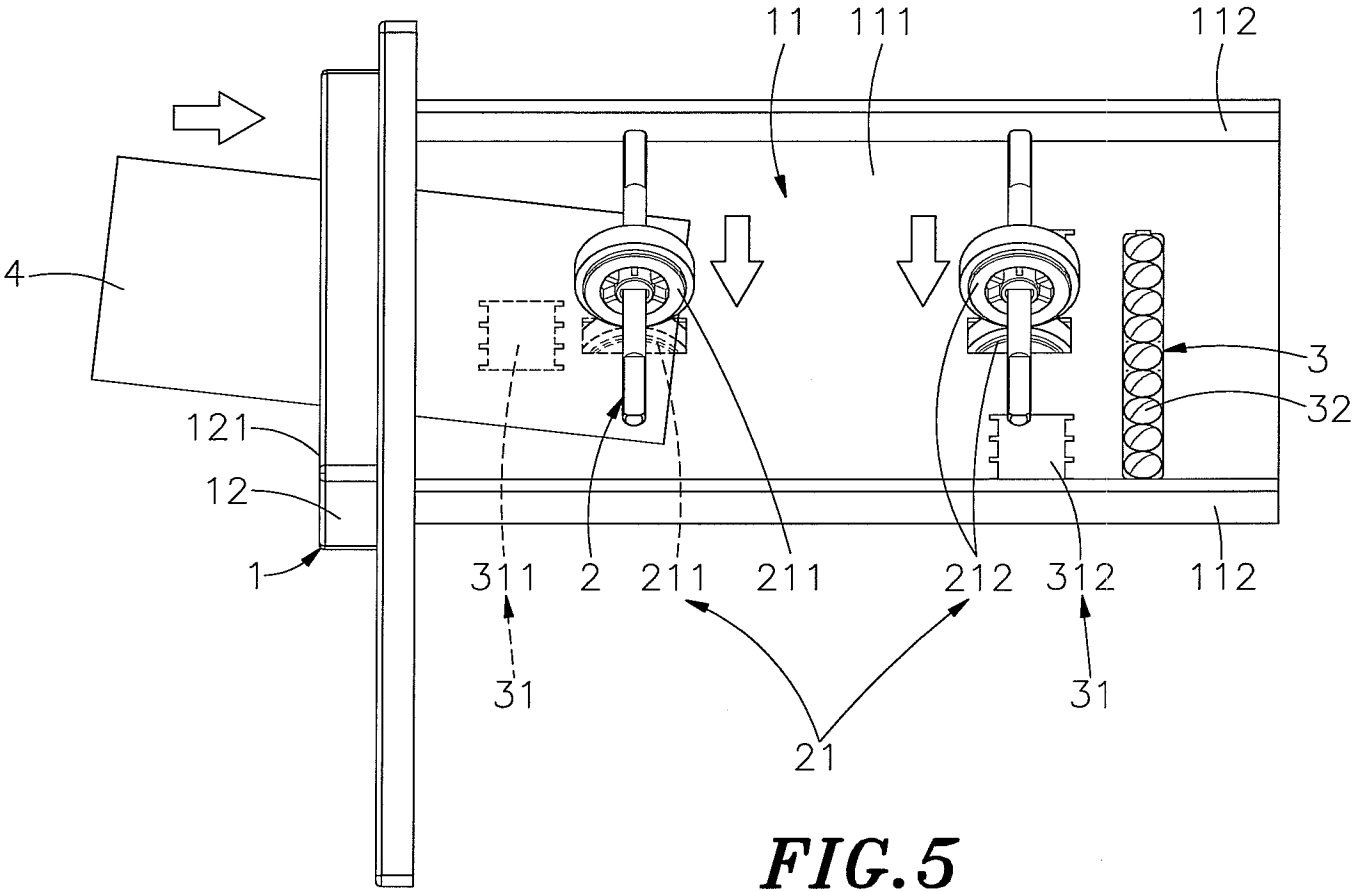
FIG. 5 corresponds to FIG. 4, illustrating the valuable document reached the first sheet-deliver wheel set of the sheet-deliver wheel module of the delivery mechanism.
Figure 6:
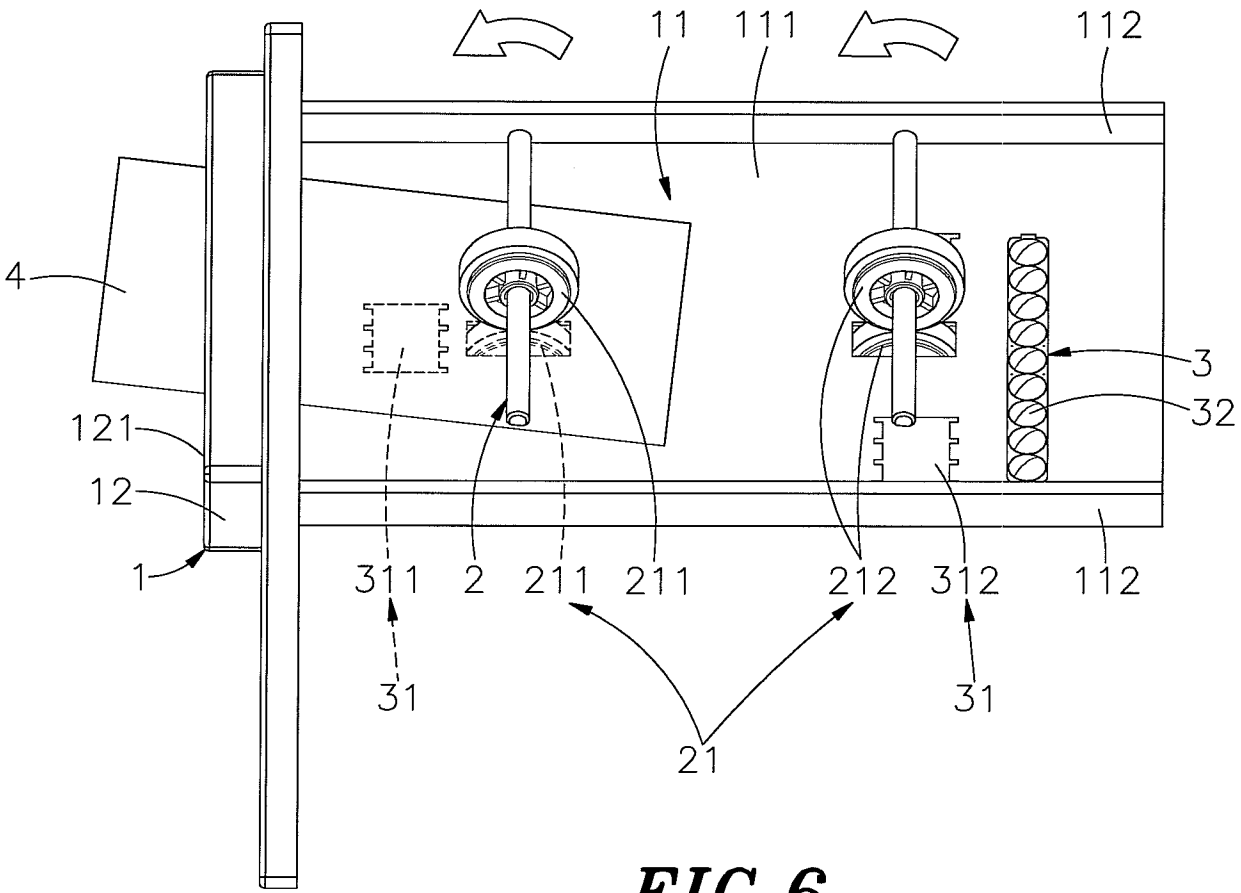
FIG. 6 corresponds to FIG. 5, illustrating the valuable document released from the user's hand and delivered forwards by the first sheet-deliver wheel set of the sheet-deliver wheel module of the delivery mechanism.
Figure 7:
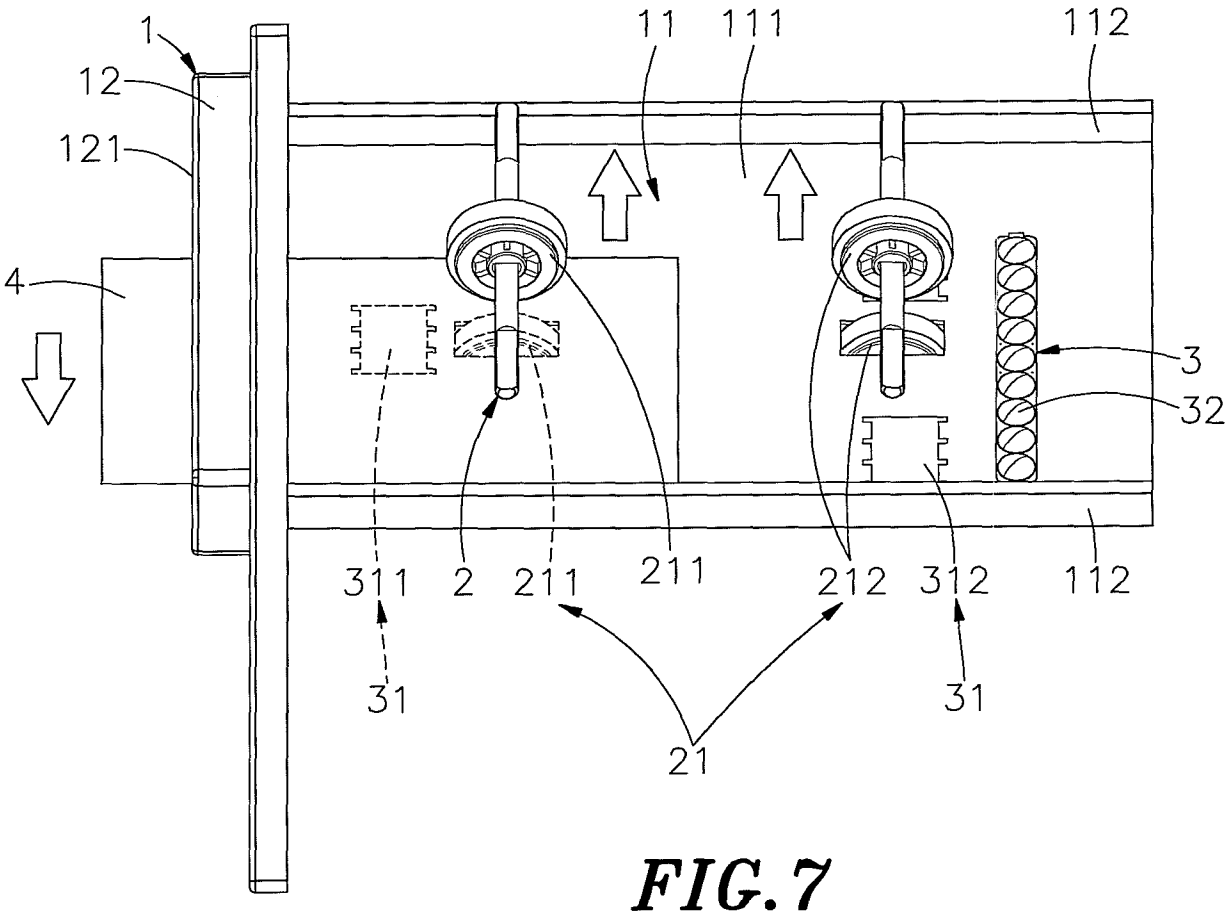
FIG. 7 corresponds to FIG. 6, illustrating the valuable document fell down and abutted with one side edge thereof against the side wall at the lower side of the tunnel.
Figure 8:
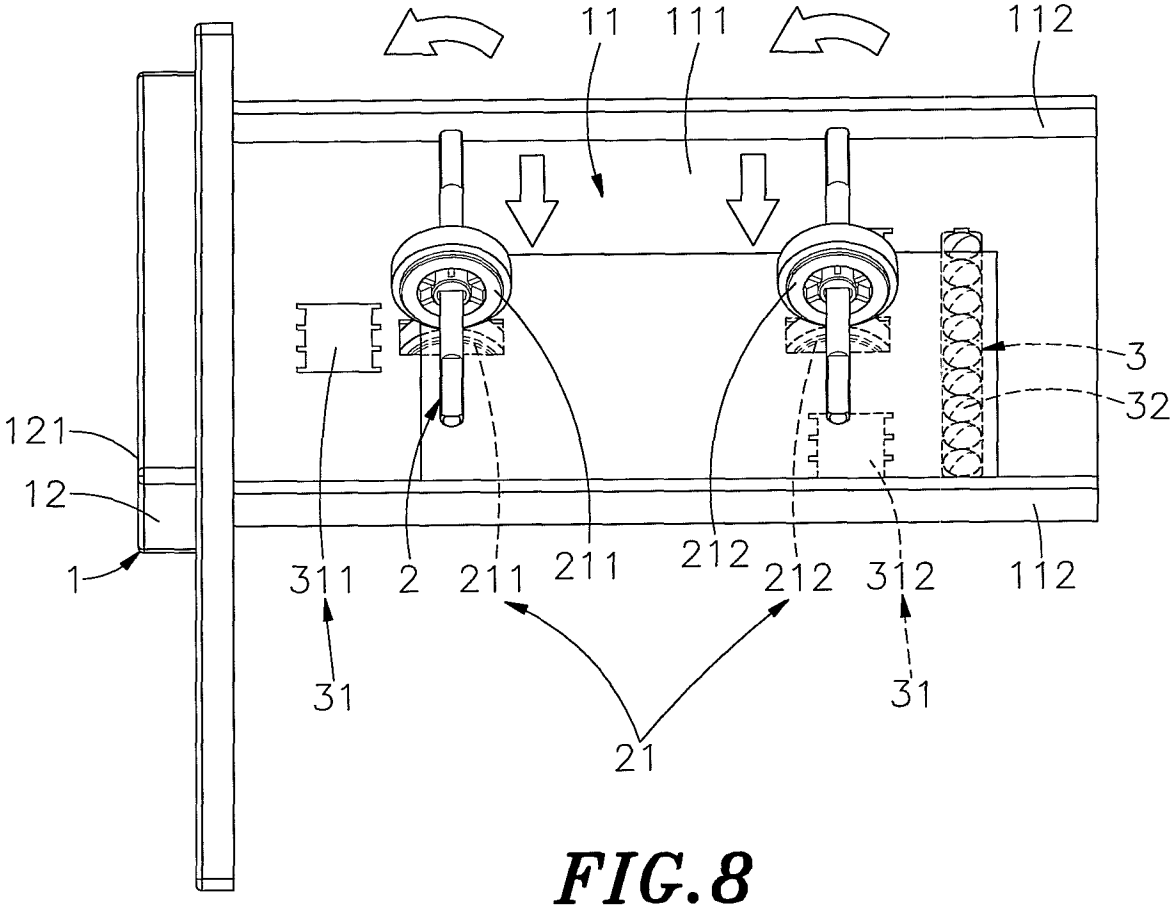
FIG. 8 corresponds to FIG. 7, illustrating the valuable document delivered by the second sheet-deliver wheel set of the sheet-deliver wheel module of the delivery mechanism to the sample identification module of the validation unit.

The housing 1 comprises a tunnel 11 surrounded by a bottom wall 111 and two side walls 112, and a face wall 12 disposed at a front side relative to the tunnel 11 and defining an insertion slot 121 in communication with the tunnel 11 for the insertion of a valuable document 4 (see also FIG. 4). The bottom wall 111 of the tunnel 11 is tilted relative to horizontal within 10°~89°. The delivery mechanism 2 and the validation unit 3 are installed in the bottom wall 111 of the tunnel 11. The delivery mechanism 2 comprises a sheet-deliver wheel module 21 and a motor (not shown) controllable to rotate the sheet-deliver wheel module 21. The validation unit 3 comprises a sensor set 31 for detecting the presence of a valuable document 4 and controlling the delivery mechanism 2 to deliver or release the sensed valuable document 4, and a sample identification module 32 adapted for identifying the authenticity and value of the sensed valuable document 4. The valuable document receiver runs subject to the following procedure:

(101) The user inserts a valuable document 4 through the insertion slot 121 into the tilted tunnel 11 in the housing 1.

(102) The sensor set 31 of the validation unit 3 senses the presence of the inserted valuable document 4 and drives the sheet-deliver wheel module 21 to hold down the valuable document 4.

(103) The sheet-deliver wheel module 21 is rotated to deliver the valuable document 4 toward the inner side of the tunnel 11, and the user releases the hand from the valuable document 4.

(104) The sheet-deliver wheel module 21 releases the valuable document 4 after the valuable document 4 has been delivered to a predetermined location in the tunnel 11, allowing the valuable document 4 to fall to one side wall 112 of the tunnel 11 and to become in alignment with the respective side wall 112 subject to the gravity.

(105) The sheet-deliver wheel module 21 is controlled to hold down the valuable document 4 again and to further deliver the valuable document 4 to the validation unit 3 for identifying its authenticity and value.

Referring to FIGS. 4~8, the valuable document receiver can be used in an automatic vending machine, gaming machine or any of a variety of, other consumer systems that provide commodity purchase services and consumer services. After installation of the housing 1 of the valuable document in the housing of an automatic vending machine or gaming machine, the electrical connectors at the circuit board carrying the delivery mechanism 2 and the validation unit 3 are electrically connected to respective mating electrical connectors of the automatic vending machine or gaming machine. Subject to the functioning of the valuable document receiver, the automatic vending machine or gaming machine accepts valuable document (paper money) transaction. With respect to the operation of the control circuit at the circuit board of the valuable document receiver in matching with the sensor set 31 of the validation unit 3 to control the delivery mechanism 2 to deliver the inserted valuable document and the operation of the sample identification module 32 of the validation unit 3 to identify the authenticity and value of the sensed valuable document, they are just an application of known techniques and not within the scope of the invention, and therefore no further detailed description in this regard is necessary.

As stated above, when the user inserts a valuable document 4 through the insertion slot 121 into the tilted tunnel 11 in the housing 1, a first sensor 311 of the sensor set 31 of the validation unit 3 senses the presence of the inserted valuable document 4 and control the delivery mechanism 2 to hold down the valuable document 4 laterally and to deliver the valuable document 4 forwards. At this time, the user feels the stretching force and releases the hand from the valuable document 4, allowing a first sheet-deliver wheel set 211 of the sheet-deliver wheel module 21 of the delivery mechanism 2 to deliver the valuable document 4 forwardly to a predetermined distance and then to release the valuable document 4. As the bottom wall 111 of the tunnel 11 is a planar wall tilted transversely and defines with the horizontal level a tilt angle relative to the horizontal within 10°~89°, the valuable document 4 will slide transversely and downwardly along the planar bottom wall 111 to one side wall 112 subject to the gravity when it is released from the constraint of the first sheet-deliver wheel set 211 of the sheet-deliver wheel module 21 of the delivery mechanism 2. At this time, the valuable document 4 will be rested on the planar bottom wall 111 of the tunnel 11 with one side edge thereof abutted against the respective side wall 112. Thus, the valuable document 4 will be kept in alignment with the respective side wall 112 accurately. After one side edge of the valuable document 4 is abutted against the respective side wall 112, the first sheet-deliver wheel set 211 of the sheet-deliver wheel module 21 of the delivery mechanism 2 is controlled to hold down the valuable document 4 again and then to deliver the valuable document 4 accurately and forwardly to a second sheet-deliver wheel set 212 of the sheet-deliver wheel module 21 of the delivery mechanism 2. When the valuable document 4 is delivered to the second sheet-deliver wheel set 212 and held down by the second sheet-deliver wheel set 212, the valuable document 4 reaches a validation position. At this time, a second sensor 312 of the sensor set 31 of the validation unit 3 senses the presence of the valuable document 4 in the validation position, and gives a signal to the delivery mechanism 2 and the validation unit 3, causing the delivery mechanism 2 to stop the sheet-deliver wheel module 21 from delivering the valuable document 4 and causing the validation unit 3 to driven the sample identification module 32 to identify the authenticity and value of the sensed valuable document 4. As stated above, the planar bottom wall 111 of the tunnel 11 is kept in a transversely tilted relative to the horizontal within 10°~89°. The valuable document 4 will slide transversely and downwardly along the planar bottom wall 111 to one side wall 112 subject to the gravity when it is released from the constraint of the first sheet-deliver wheel set 211, and therefore, the valuable document 4 will be automatically kept in accurate alignment with one side wall 112 of the tunnel 11 without using any complicated alignment mechanism or position adjustment mechanism, facilitating accurate valuable document validation and saving much the cost.

If the valuable document 4 is recognized by the sample identification module 32 to be a true copy, the validation unit 3 immediately gives a signal to the delivery mechanism 2, causing it to drive the second sheet-deliver wheel set 212 of the stop the sheet-deliver wheel module 21 in delivering the valuable document 4 toward the rear side of the tunnel 11. Further, an anti-theft hook (not shown) is installed in the rear side of the tunnel 11 inside the housing 1 to prevent pilferage, avoiding an evil person from pulling back the inserted valuable document with an iron wire, adhesive tape or any of a variety of other tools. Immediately after the valuable document 4 passed the anti-theft hook, it is carried by a valuable document receiving and discharging device (not shown) to a valuable document box (not shown) and held therein by a valuable document pressing mechanism (not shown). On the contrary, if the valuable document 4 is examined by the sample identification module 32 to be a counterfeit, the validation unit 3 immediately gives a signal to the delivery mechanism 2, causing the sheet-deliver wheel module 21 to deliver the valuable document 4 backwardly toward the insertion slot 121 in the face wall 12.

Figure 9:
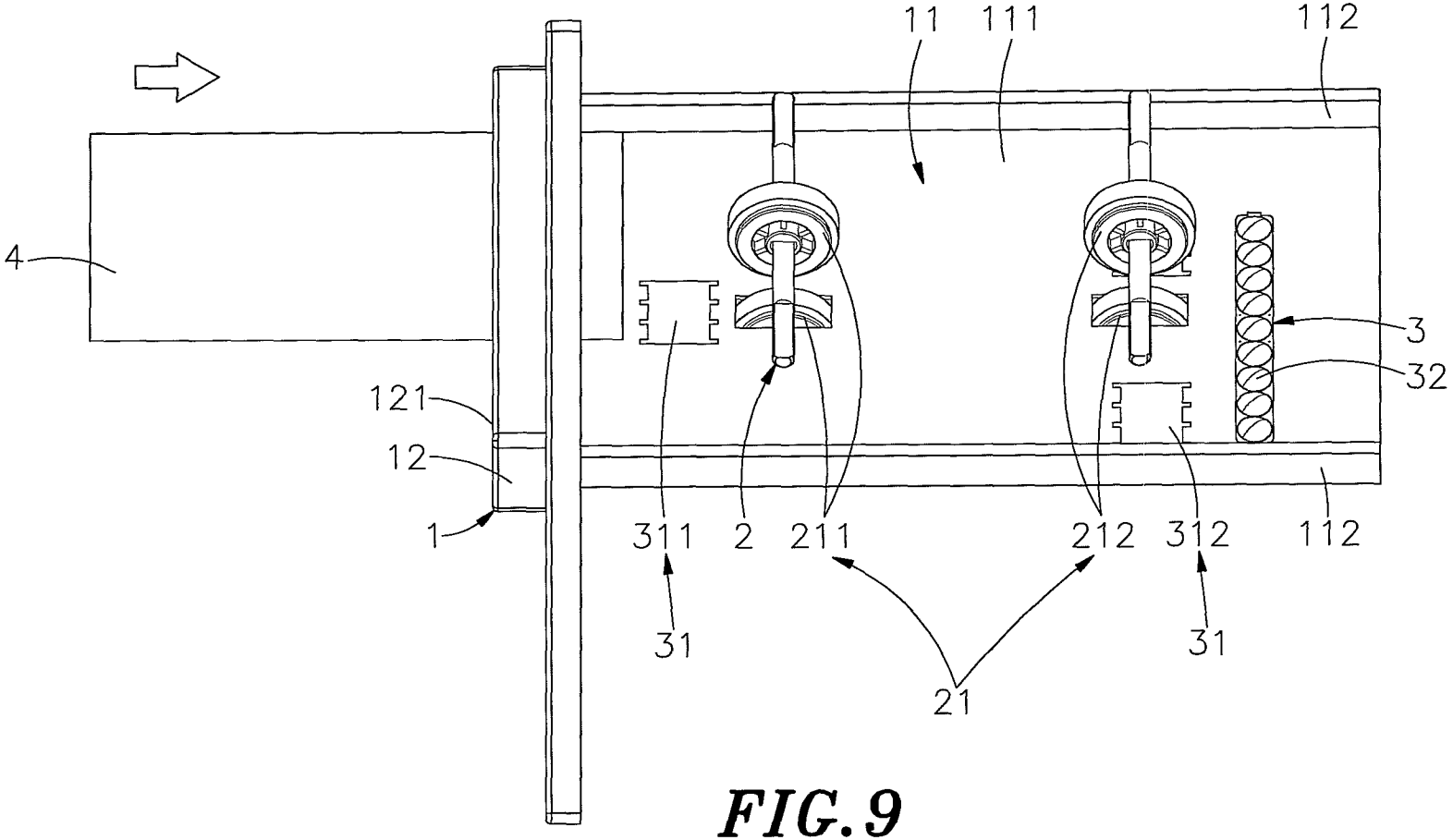
FIG. 9 is a schematic side view illustrating a valuable document inserted into the insertion slot of the valuable document receiver and abutted against the side wall at the upper side of the tunnel in accordance with the present invention.

Referring to FIG. 9 and FIGS. 1 and 4 again, when a user is inserting a valuable document 4 into the insertion slot 121 in the face wall 12 in an oblique manner as shown in FIG. 4 or a straight manner to keep one side edge of the valuable document 4 in contact with the side wall 112 at the upper side as shown in FIG. 9, the valuable document 4 can be guided by the insertion slot 121 to the first sheet-deliver wheel set 211 of the sheet-deliver wheel module 21 of the delivery mechanism 2 and then delivered forwardly by the sheet-deliver wheel module 21 to a predetermined distance. After the valuable document 4 has been delivered by the first sheet-deliver wheel set 211 to the inside of the tunnel 11, the sheet-deliver wheel module 21 is controlled to release the valuable document 4, enabling the valuable document 4 to slide transversely and downwardly along the planar bottom wall 111 to one side wall 112 subject to the gravity and the tilted arrangement of the bottom wall 111 of the tunnel 11 where relative to the horizontal within 10°~89°. Thus, the valuable document 4 can be rested on the planar bottom wall 111 of the tunnel 11 with one side edge thereof abutted against the side wall 112 at the lower side, i.e., the valuable document 4 can be kept in alignment with the side wall 112 at the lower side in a smooth manner without wrinkles. As the valuable document 4 can be automatically kept in accurate alignment with the lower-sided side wall 112 of the tunnel 11 without using any complicated alignment mechanism or position adjustment mechanism, the structural arrangement of the valuable document receiver is simplified, facilitating maintenance and saving cost. Further, the valuable document 4 can be paper money, security (check, bill of exchange, stock, certificate of title, prepaid ticket or coupon), security document (personal identification card, car license, driver license or passport).

As stated above, the tilted planar bottom wall 111 of the tunnel 11 relative to the horizontal within 10°~89°. If the tilt angle is smaller than 10°, the gravity of the valuable document 4 may be unable to overcome the friction resistance between the valuable document 4 and the tilted planar bottom wall 111 of the tunnel 11. In this case, the valuable document 4 may not fall to the side wall 112 at the lower side. Further, the material and size of the valuable document 4, for example, the softness of the material, the thickness and the ratio between the length and width of the valuable document 4 may affect the friction between the valuable document 4 and the planar bottom wall 111. Therefore, it is preferable to keep the tilt angle between the tilted planar bottom wall 111 of the tunnel 11 and the horizontal level within the range of 30°~75°, enabling the valuable document 4 to effectively downwardly slide to the aligned position with one side edge thereof abutted against the side wall 112 at the lower side, facilitating further validation procedure.

In conclusion, when one user inserts a valuable document 4 into the insertion slot 121 toward the tunnel 11 of the housing 1 of the valuable document receiver, the sensor set 31 of the validation unit 3 immediately senses the presence of the inserted valuable document 4 and drives the delivery mechanism 2 to hold down the inserted valuable document 4 and to deliver the valuable document 4 forwards. After the user felt the stretching force and released the hand from the inserted valuable document 4, the sheet-deliver wheel module 21 of the delivery mechanism 2 delivers the valuable document 4 forwardly to a predetermined distance and then releases the valuable document 4, enabling the valuable document 4 to slide downwardly into accurate alignment with the tunnel 11 subject to the gravity and the transversely tilted arrangement of the bottom wall 111 of the tunnel 11 that relative to the horizontal within 10°~89°, and thereafter the sheet-deliver wheel module 21 of the delivery mechanism 2 holds down the valuable document 4 again and delivers it to the sample identification module 32 of the validation unit 3 for enabling the sample identification module 32 to identify the authenticity and value of the valuable document 4. By means of utilizing the gravity of the valuable document 4 to let the valuable document 4 be accurately aligned with the tunnel 11 without using any complicated alignment mechanism or position adjustment mechanism, the invention facilitates accurate valuable document validation and saves cost.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A valuable document receiving and alignment method used in a valuable document receiver comprising;

a valuable document receiver comprising, a housing defining a transversely tilted tunnel, a delivery mechanism mounted in said transversely tilted tunnel of said housing and controllable to hold down and deliver an inserted valuable document by means of a sheet-deliver wheel module thereof, and a validation unit adapted for sensing the insertion of a valuable document into said transversely tilted tunnel controlling the operation of said delivery mechanism and identifying the authenticity and value of the sensed valuable document, the valuable document receiving and alignment method comprising the steps of:

(a) a user inserts a valuable document obliquely into said transversely tilted tunnel;

(b) said validation unit of said valuable document receiver senses the presence of the inserted valuable document and controls said delivery mechanism to hold down the inserted valuable document;

(c) said sheet-deliver wheel module of said delivery mechanism is controlled to deliver the inserted valuable document forwardly to a predetermined distance and at the same time the user releases his/her hand from the inserted valuable document for enabling the inserted valuable document to be delivered by said sheet-deliver wheel module;

(d) said sheet-deliver wheel module releases the valuable document for enabling the valuable document to fall downwardly to the lower side wall of said transversely tilted tunnel and to let one side edge of the valuable document be abutted against the lower side wall of said transversely tilted tunnel;

(e) said sheet-deliver wheel module is controlled to deliver the valuable document to a validation position for enabling said validation unit to identify the authenticity and value of the valuable document.

2. The valuable document receiving and alignment method as claimed in claim 1, wherein said transversely tilted tunnel has a planar bottom wall relative to the horizontal within 10°~89°.

3. The valuable document receiving and alignment method as claimed in claim 2, wherein said tilt angle is within the range of 30°~75°.

4. The valuable document receiving and alignment method as claimed in claim 1, wherein said housing comprises a face wall disposed at a front side thereof and an insertion slot cut through said face wall in communication and alignment with said transversely tilted tunnel.

5. The valuable document receiving and alignment method as claimed in claim 1, wherein said delivery mechanism further comprises a motor adapted for rotating said sheet-deliver wheel module.

6. The valuable document receiving and alignment method as claimed in claim 1, wherein said validation unit comprises a sensor set adapted for sensing the position of the inserted valuable document and a sample identification module adapted for identifying the authenticity and value of the valuable document.

* * * * *